US009466315B2

(12) United States Patent
Zhao et al.

(10) Patent No.: US 9,466,315 B2
(45) Date of Patent: Oct. 11, 2016

(54) SYSTEM AND METHOD FOR CALCULATING SIMILARITY OF AUDIO FILE

(71) Applicant: TENCENT TECHNOLOGY (SHENZHEN) COMPANY LIMITED, Shenzhen, Guangdong (CN)

(72) Inventors: Weifeng Zhao, Guangdong (CN); Shenyuan Li, Guangdong (CN); Liwei Zhang, Guangdong (CN); Jianfeng Chen, Guangdong (CN)

(73) Assignee: Tencent Technology (Shenzhen) Company Limited, Guangdong (CN)

( * ) Notice: Subject to any disclaimer, the term of this patent is extended or adjusted under 35 U.S.C. 154(b) by 109 days.

(21) Appl. No.: 14/450,675

(22) Filed: Aug. 4, 2014

(65) Prior Publication Data

US 2014/0343933 A1 Nov. 20, 2014

Related U.S. Application Data

(63) Continuation of application No. PCT/CN2013/090491, filed on Dec. 26, 2013.

(30) Foreign Application Priority Data

Apr. 18, 2013 (CN) ..... 2013 1 0135210

(51) Int. Cl.
*G10L 25/00* (2013.01)
*G10L 25/54* (2013.01)
*G10L 25/90* (2013.01)

(52) U.S. Cl.
CPC ..... *G10L 25/00* (2013.01); *G10L 25/54* (2013.01); *G10L 25/90* (2013.01)

(58) Field of Classification Search
CPC ..... G10L 15/002
See application file for complete search history.

(56) References Cited

U.S. PATENT DOCUMENTS 5,255,342 A * 10/1993 Nitta ..... G06K 9/64 704/200
5,774,837 A * 6/1998 Yeldener ..... G10L 19/18 704/206
5,918,223 A * 6/1999 Blum ..... G06F 17/30017
2002/0181711 A1* 12/2002 Logan ..... G11B 27/105 381/1

(Continued)

FOREIGN PATENT DOCUMENTS

CN 102521281 A 6/2012
EP 2402937 A 1/2012

OTHER PUBLICATIONS

Office Action issued in corresponding Chinese Application No. 201310135210.7, mailed on Jul. 24, 2015.

(Continued)

*Primary Examiner* — Douglas Godbold
(74) *Attorney, Agent, or Firm* — Frommer Lawrence & Haug LLP; William S. Frommer

(57) ABSTRACT

A method for calculating a similarity of audio files includes constituting a pitch sequence of a first audio file and a pitch sequence of a second audio file; calculating an eigenvector of the first audio file according to the pitch sequence of the first audio file, and calculating an eigenvector of the second audio file according to the pitch sequence of the second audio file; calculating a similarity between the first audio file and the second audio file according to the eigenvector of the first audio file and the eigenvector of the second audio file.

9 Claims, 4 Drawing Sheets

(56) References Cited

U.S. PATENT DOCUMENTS

2004/0220800 A1* 11/2004 Kong ..... G10L 21/0208 704/205
2008/0300702 A1* 12/2008 Gomez ..... G06F 17/30743 700/94
2013/0325759 A1* 12/2013 Rachevsky ..... G06N 99/005 706/12
2014/0336537 A1* 11/2014 Patel ..... A61B 7/003 600/586
2014/0343933 A1* 11/2014 Zhao ..... G10L 25/00 704/207

OTHER PUBLICATIONS

International Search Report issued in corresponding International Application No. PCT/CN2013/090491 mailed on Apr. 3, 2014.

* cited by examiner

SYSTEM AND METHOD FOR CALCULATING SIMILARITY OF AUDIO FILE

CROSS REFERENCE TO RELATED APPLICATIONS

The present application is a continuation application of PCT Patent Application No. PCT/CN2013/090491, filed on Dec. 26, 2013, which claims the benefit of priority to China patent application NO. 201310135210.7 filed in the Chinese Patent Office on Apr. 18, 2013 and entitled "SYSTEM AND METHOD FOR CALCULATING SIMILARITY OF AUDIO FILE", the content of which is hereby incorporated by reference in its entirety.

FIELD OF THE TECHNICAL

The disclosure relates to network technology fields, and particularly to an audio processing technology field, more especially to a system and method for calculating a similarity of audio files.

BACKGROUND

The section provides background information related to the present disclosure which is not necessarily prior art.

Presently, there are two methods for calculating a similarity of audio files. One of the two methods is a manual calculation method. That is, professionals are needed to analyze two audio files, and determine whether the two audio files are the similar, and determine a similarity of the two audio files. However, the manual calculation method costs lots of manpower, has a lower efficiency of calculating the similarity, and lacks of intelligence. The other of the two methods is an equipment calculation method based on attribute of the audio files. That is, computer equipments is applied to calculate the similarity of the two audio files based on genres, albums, and authors of the two audio files, to get the similarity of the two audio files. However, the equipment calculation method fails to consider audio contents of the two audio files, and belongs to a easy attribute association calculation method. Therefore, an accuracy of calculating the similarity is lower.

SUMMARY

The disclosed method and device for calculating a similarity of audio files are directed to solve one or more problems set forth above and other problems.

This section provides a general summary of the disclosure, and is not a comprehensive disclosure of its full scope or all of its features.

Further areas of applicability will become apparent from the description provided herein. The description and specific examples in this summary are intended for purposes of illustration only and are not intended to limit the scope of the present disclosure.

A method for calculating a similarity of audio files, comprising:

constituting a pitch sequence of a first audio file and a pitch sequence of a second audio file;

calculating an eigenvector of the first audio file according to the pitch sequence of the first audio file, and calculating an eigenvector of the second audio file according to the pitch sequence of the second audio file;

calculating a similarity between the first audio file and the second audio file according to the eigenvector of the first audio file and the eigenvector of the second audio file.

A device for calculating a similarity of audio files, comprising:

a constitution module configured to constitute a pitch sequence of a first audio file and a pitch sequence of a second audio file;

a first calculation module configured to calculate an eigenvector of the first audio file according to the pitch sequence of the first audio file, and calculate an eigenvector of the second audio file according to the pitch sequence of the second audio file;

a second calculation module configured to calculate a similarity between the first audio file and the second audio file according to the eigenvector of the first audio file and the eigenvector of the second audio file.

BRIEF DESCRIPTION OF THE DRAWINGS

In order to illustrate the embodiments or existing technical solutions more clearly, a brief description of drawings that assists the description of embodiments of the invention or existing art will be provided below. It would be apparent that the drawings in the following description are only for some of the embodiments of the invention. A person having ordinary skills in the art will be able to obtain other drawings on the basis of these drawings without paying any creative work.

DETAILED DESCRIPTION OF ILLUSTRATED EMBODIMENTS

Technical solutions in embodiments of the present invention will be illustrated clearly and entirely with the aid of the drawings in the embodiments of the invention. It is apparent that the illustrated embodiments are only some embodiments of the invention instead of all of them. Other embodiments that a person having ordinary skills in the art obtains based on the illustrated embodiments of the invention without paying any creative work should all be within the protection scope sought by the present invention.

In embodiments, audio files may include songs, song snippets, music, and music snippets. The audio files also may include other files. A first audio file may be any audio file. A second audio file may be any audio file except for the first audio file. In the embodiment, a method for calculating the similarity of the audio files is applied to audio libraries of the network to search the similar audio files. For example, the method for calculating the similarity of the audio files is applied to the audio libraries of the network to search the similar songs. If users want to search songs similar to the song A, similarities between the song A and all songs in the audio libraries of the network are respectively calculated. The song corresponding to the greatest similarity in the calculated similarities is determined to be used to the similarity song of the song A. Moreover, the method for calculating the similarity of the audio files is also applied to the audio libraries of the network to search music. If the users want to search music similar to the music B, similarities between the music B and all music in the audio libraries of the network are respectively calculated. The music corresponding to the greatest similarity in the calculated similarities is determined to be used to the similarity music of the music B. In the embodiment, the method for calculating the similarity of the audio files is also applied to recommending audio files of the network. For example, the method is applied to recommend songs of the network. If a user is listening to a song C, similarity songs similar to the song C can be searched in the audio libraries of the network, and are recommended to the user. Moreover, the method is also applied to recommend music of the network. If the user is listening to music D, similarity music similar to the music D can be searched in the audio libraries of the network, and are recommended to the user.

The method for calculating similarities of audio files in the following embodiments is detailed described according to FIG. 1 and FIG. 2.

Figure 1:
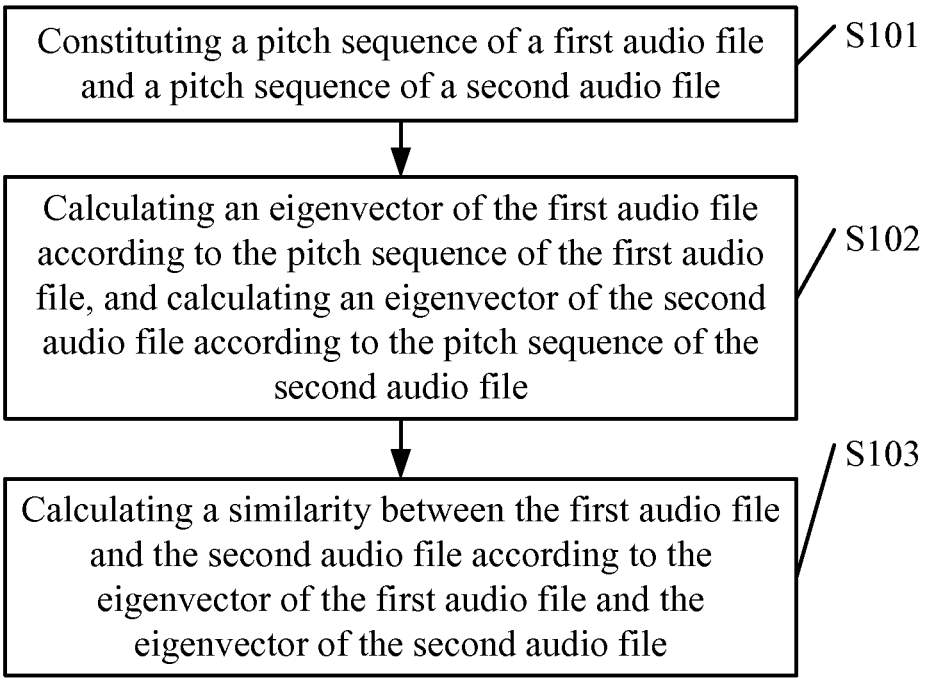
FIG. 1 is a flowchart of an example of a method for calculating a similarity of audio files according to various embodiments.

Referring to FIG. 1, it is a flowchart of an example of a method for calculating a similarity of audio files. The method may include the following steps 101 to 103.

Step 101: constituting a pitch sequence of a first audio file and a pitch sequence of a second audio file.

An audio file can be represented as a sequence of frames which is composed of a plurality of audio frames. Frame length T and frame shift are time. Values of the frame length T and the frame shift Ts can be determined according to need. For example, for a song, the value of the frame length T may be 20 ms, the value of the frame shift Ts may be 10 ms. Moreover, for a piece of music, the value of the frame length T may be 10 ms, the value of the frame shift Ts may be 5 ms. For different audio files, the value of the frame length T may be different, also may be the same. The value of the frame shift may be different, also may be the same. Each audio frame of the audio file carries the pitches. Melody information of the audio file is constituted by the pitches of each audio frame according to the time sequence of the audio frames. In the step 101, the pitch sequence of the first audio file is constituted according to the pitches of each audio frame of the first audio file. And the pitch sequence of the second audio file is constituted according to the pitches of each audio frame of the second audio file. The pitch sequence of the first audio file includes the pitches of each audio frame of the first audio file. The melody of the first audio file is constituted by the pitches of the first audio file in sequence. The pitch sequence of the second audio file includes the pitches of each audio frame of the second audio file. The melody of the second audio file is constituted by the pitches of the second audio file in sequence.

Step 102: calculating an eigenvector of the first audio file according to the pitch sequence of the first audio file, and calculating an eigenvector of the second audio file according to the pitch sequence of the second audio file.

Specifically, the eigenvector of the audio file can abstractly represent audio contents of the audio file. In detail, the eigenvector of the audio file can abstractly represent the audio contents of the audio file through characteristic parameters. The first eigenvector of the first audio file includes the characteristic parameters of the first audio file. The eigenvector of the second audio file includes the characteristic parameters of the second audio file. The characteristic parameters may include, but are not limited to include only the following parameters: a pitch mean, a pitch standard deviation, a width of the pitch variation, a proportion of the pitch ascending, a proportion of the pitch descending, a proportion of zero pitch, an average rate of the pitch ascending, and an average rate of the pitch descending.

Step 103, calculating a similarity between the first audio file and the second audio file according to the eigenvector of the first audio file and the eigenvector of the second audio file.

Owing to the eigenvector of the audio file can abstractly represent the audio contents of the audio files, the step 103 can obtain the similarity between the first audio file and the second audio file through analyzing and calculating the eigenvectors of the first and second audio files. It should be noted that the similarity between the first and second audio files is calculated based on the audio contents of the first and second audio files. Therefore, that calculating the similarity between the first and second audio files is interfered by other factors excluding the audio contents of the first and second audio files, which improves an accuracy of calculating the similarity of audio files.

In the embodiment, the pitch sequences of the first and second audio files are constituted based on the corresponding eigenvectors of the first and second audio files. The above-mentioned method for calculating the similarity of the audio files adopts the eigenvectors to abstractly represent the audio contents of the audio files. Further, the similarity between the first and second audio files is calculated according to the eigenvectors of the first and second audio files. The similarity between the first and second audio files is calculated based on the audio contents of the first and second audio files. Therefore, that calculating the similarity between the first and second audio files is interfered by other factors excluding the audio contents of the first and second audio files, which improves the accuracy, efficiency, and intelligence of calculating the similarity of audio files.

Figure 2:
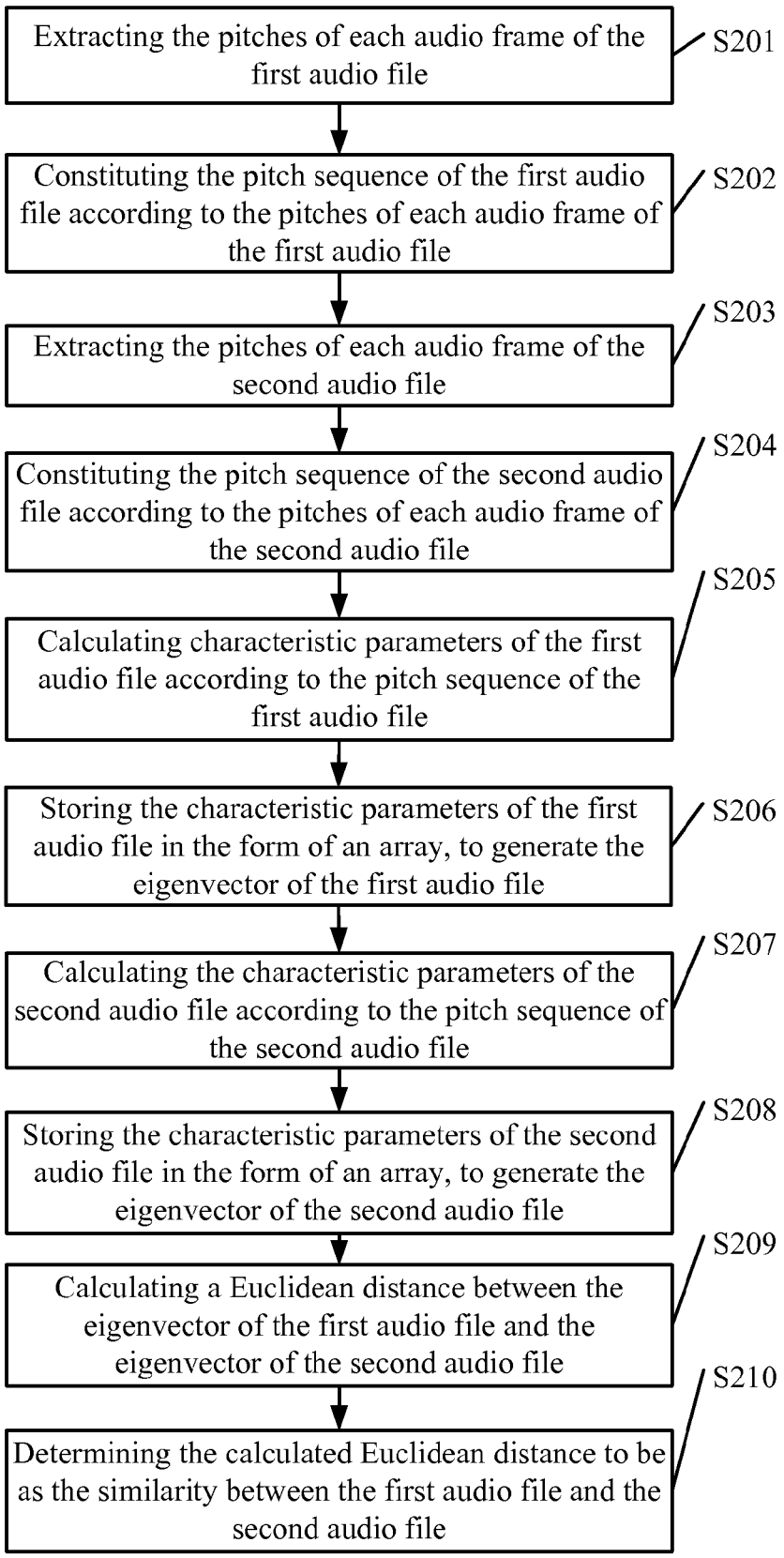
FIG. 2 is a flowchart of another example of a method for calculating a similarity of audio files according to various embodiments.

Referring to FIG. 2, it is a flowchart of another example of a method for calculating a similarity of audio files according to various embodiments. The method may include the following steps S201 to S210.

Step 201: extracting the pitches of each audio frame of the first audio file.

An audio file can be represented as a sequence of frames which is composed of a plurality of audio frames. Frame length T and frame shift are time. Values of the frame length T and the frame shift Ts can be determined according to need. For example, for a song, the value of the frame length T may be 20 ms, the value of the frame shift Ts may be 10 ms. Moreover, for a piece of music, the value of the frame length T may be 10 ms, the value of the frame shift Ts may be 5 ms. For different audio files, the value of the frame length T may be different, also may be the same. The value of the frame shift Ts may be different, also may be the same. Each audio frame of the audio file carries the pitches. Melody information of the audio file is constituted by the pitches of each audio frame according to the time sequence of the audio frames. If the first audio file includes $n_1$ ($n_1$ is a positive integer) audio frames. The pitches of a first audio frame are defined as $S_1(1)$. The pitches of a second audio frame are defined as $S_1(2)$. By that analogy, the pitches of the $(n_1-1)$th audio frame are defined as $S_1(n_1-1)$. The pitches of the $n_1$ th audio frame are defined as $S_1(n_1)$. In the step 201, the pitches $S_1(1)$–$S_1(n_1)$ are extracted from the first audio file.

Step 202, constituting the pitch sequence of the first audio file according to the pitches of each audio frame of the first audio file.

The pitch sequence of the first audio file includes the pitches of each audio frame of the first audio file. The pitches of the Pitch sequence of the first audio file constitute the melody information of the first audio file in sequence. In the step 202, the pitch sequence of the first audio file is expressed as a $S_1$ sequence. The $S_1$ sequence includes $n_1$ pitches, which are $S_1(1)$, $S_1(2)$ . . . $S_1(n_1-1)$, $S_1(n_1)$. The $n_1$ pitches constitute the melody of the first audio file. Specifically, the step 201 has the following two embodiments. In one of the two embodiments, the pitch sequence of the first audio file is constituted through adopting a pitch extraction algorithm. The pitch extraction algorithm includes, but is not limited to include: an autocorrelation function method, a peak extraction algorithm, an average magnitude difference function method, a cepstrum method, and a spectrum method. In the other of the two embodiments, the pitch sequence of the first audio file is constituted through adopting a pitch extraction tool. The pitch extraction tool includes, but is not limited to include: a fxpefac tool or a fxrapt tool of the voicebox (a matlab voice processing tool box).

Step 203: extracting the pitches of each audio frame of the second audio file.

An extraction process of extracting the pitches of each audio frame of the second audio file is the same as an extraction process of extracting the pitches of each audio frame of the first audio file. Therefore, the extraction process of extracting the pitches of each audio frame of the second audio file will not be described. If the second audio file includes $n_2$ ($n_2$ is a positive integer) audio frames. The pitches of a first audio frame is defined as $S_2(1)$. The pitches of a second audio frame is defined as $S_2(2)$. By that analogy, the pitches of the $(n_2-1)$th audio frame is defined as $S_2(n_2-1)$. The pitches of the $n_2$th audio frame is defined as $S_2(n_2)$. In the step 203, the pitches $S_2(1)$–$S_2(n_2)$ are extracted from the second audio file. It should be noted that $n_1$ and $n_2$ may be the same, also may be different.

Step 204, constituting the pitch sequence of the second audio file according to the pitches of each audio frame of the second audio file.

The pitch sequence of the second audio file includes the pitches of each audio frame of the second audio file. The pitches of the pitch sequence of the second audio file constitute the melody information of the second audio file in sequence. In the step 204, the pitch sequence of the second audio file is expressed as a $S_2$ sequence. The $S_2$ sequence includes $n_2$ pitches, which are $S_2$ (1), $S_2(2)$ . . . $S_2(n_2-1)$, $S_2(n_2)$. The $n_2$ pitches constitute the melody of the second audio file. A constitution process of constituting the melody information of the second audio file is the same as a constitution process of constituting the melody information of the first audio file. Therefore, the constitution process of constituting the melody information of the second audio file will not be described.

In the embodiments, the steps 201 and 203 are in no particular order on timing. The steps 201 and 203 can be simultaneously implemented. Or the steps 201 and 202 are implemented firstly, and then the steps 203 and 204 are implemented. The steps 201-204 of the embodiment may be the detailed flow of the step 101 of the embodiment corresponding to the FIG. 1.

Step 205: calculating characteristic parameters of the first audio file according to the pitch sequence of the first audio file.

The characteristic parameters may include, but are not limited to include only the following parameters: a pitch mean, a pitch standard deviation, a width of the pitch variation, a proportion of the pitch ascending, a proportion of the pitch descending, a proportion of zero pitch, an average rate of the pitch ascending, and an average rate of the pitch descending. In order to more accurately reflect the audio content of the first audio file, in the embodiment, preferably, the characteristic parameters of the audio files includes the pitch mean, the pitch standard deviation, the width of the pitch variation, the proportion of the pitch ascending, the proportion of the pitch descending, the proportion of zero pitch, the average rate of the pitch ascending, and the average rate of the pitch descending. The definitions and calculations for each characteristic parameter of the first audio file are as follows:

a) For the pitch mean, it represents a mean pitch of the pitch sequence of the first audio file (namely the $S_1$ sequence). The pitch mean is expressed as $E_1$. In the step 205, the pitch mean $E_1$ of the first audio file can be calculated through adopting the following formulas (1):

$$E_1 = \frac{1}{n_1}\sum_{i=1}^{n_1} S_1(i) \tag{1}$$

Wherein, $E_1$ denotes the pitch mean of the first audio file; $n_1$ is a positive integer, $n_1$ denotes the number of the pitches of the pitch sequence of the first audio file; i is a positive integer and $i \le n_1$, i denotes the serial number of the pitches of the pitch sequence (namely $S_1$ sequence) of the first audio file; $S_1(i)$ denotes any pitch of the pitch (namely $S_1$ sequence) of the first audio file.

b) For the pitch standard deviation, it represents pitch variations of the pitch sequence (namely $S_1$ sequence) of the first audio file. The pitch standard deviation is expressed as $S_{td1}$. In the step 205, the pitch standard deviation $S_{td1}$ of the first audio file can be calculated through adopting the following formulas (2):

$$S_{td1} = \sqrt{\frac{1}{n_1}\sum_{i=1}^{n_1} (S_1(i) - E_1)^2} \tag{2}$$

Wherein, $S_{td1}$ denotes the pitch standard deviation of the first audio file; $n_1$ is a positive integer, $n_1$ denotes the number of the pitches of the pitch sequence of the first audio file; i is a positive integer and $i \le n_1$, i denotes the serial number of the pitches of the pitch sequence (namely $S_1$ sequence) of the first audio file; $S_1(i)$ denotes any pitch of the pitch sequence (namely $S_1$ sequence) of the first audio file; $E_1$ denotes the pitch mean of the first audio file.

c) For the width of the pitch variation, it represents a range of the pitch variation of the pitch sequence (namely $S_1$ sequence) of the first audio file. The width of the pitch variation is expressed as $R_1$. In the step 205, the width of the pitch variation $R_1$ of the first audio file can be calculated through adopting the following formulas (3):

$$R_1 = E_{max1} - E_{min1} \tag{3}$$

Wherein, $R_1$ denotes the width of the pitch variation. A process of calculating $E_{max1}$ may be as follows: the $n_1$ pitches of the pitch sequence of the first audio file are sorted in descending order, to constitute a $S'_1$ sequence. The $m_1$ pitches are selected from the $S'_1$ sequence. The mean of the selected $m_1$ pitches is calculated, wherein, $m_1$ is a positive integer, and $m_1 \leq n_1$. For example, suppose the Pitch sequence (namely $S_1$ sequence) of the first audio file includes ten pitches, which are $S_1(1)=1$ Hz, $S_1(2)=0.5$ Hz, $S_1(3)=4$ Hz, $S_1(3)=4$ Hz, $S_1(4)=2$ Hz, $S_1(5)=5$ Hz, $S_1(6)=1.5$ Hz, $S_1(7)=3$ Hz, $S_1(8)=2.5$ Hz, $S_1(9)=3.5$ Hz, $S_1(10)=6$ Hz. The value of $m_1$ is 2. Therefore, the process of calculating $E_{max1}$ is as the follows: the $n_1$ pitches of the Pitch sequence of the first audio file are sorted in descending order, to constitute the $S'_1$ sequence. The order of the ten pitches of the $S_1'$ sequence is as the follows: $S_1(10)=6$ Hz, $S_1(5)=5$ Hz, $S_1(3)=4$ Hz, $S_1(9)=3.5$ Hz, $S_1(7)=3$ Hz, $S_1(8)=2.5$ Hz, $S_1(4)=2$ Hz, $S_1(6)=1.5$ Hz, $S_1(1)=1$ Hz, $S_1(2)=0.5$ Hz. The two selected pitches from the $S'_1$ sequence are $S_1(10)=6$ Hz and $S_1(5)=5$ Hz; The pitch mean of the $S_1(10)=6$ Hz and $S_1(5)=5$ Hz is equal to $\frac{1}{2}(S_1(5)+S_1(10))=\frac{1}{2}(5\text{ Hz}+6\text{ Hz})=5.5$ Hz. Therefore, the value of $E_{max1}$ is equal to 5.5 Hz.

A process of calculating $E_{min1}$ may be as follows: the $n_1$ pitches of the Pitch sequence of the first audio file are sorted in ascending order, to constitute a $S''_1$ sequence. The $m_1$ pitches are selected from the $S''_1$ sequence. The mean of the selected $m_1$ pitches is calculated, wherein, $m_1$ is a positive integer, and $m_1 \leq n_1$. For example, suppose the pitch sequence (namely $S_1$ sequence) of the first audio file includes ten pitches, which are $S_1(1)=1$ Hz, $S_1(2)=0.5$ Hz, $S_1(3)=4$ Hz, $S_1(3)=4$ Hz, $S_1(4)=2$ Hz, $S_1(5)=5$ Hz, $S_1(6)=1.5$ Hz, $S_1(7)=3$ Hz, $S_1(8)=2.5$ Hz, $S_1(9)=3.5$ Hz, $S_1(10)=6$ Hz. The value of $m_1$ is 2. Therefore, the process of calculating $E_{min1}$ is as the follows: the $n_1$ pitches of the pitch sequence of the first audio file are sorted in ascending order, to constitute the $S''_1$ sequence. The order of the ten pitches of the $S''_1$ sequence is as the follows: $S_1(2)=0.5$ Hz, $S_1(1)=1$ Hz, $S_1(6)=1.5$ Hz, $S_1(4)=2$ Hz, $S_1(8)=2.5$ Hz, $S_1(7)=3$ Hz, $S_1(9)=3.5$ Hz, $S_1(3)=4$ Hz, $S_1(5)=5$ Hz, $S_1(10)=6$ Hz. The two selected pitches from the $S''_1$ sequence are $S_1(2)=0.5$ Hz and $S_1(1)=1$ Hz. The pitch mean of the $S_1(1)=1$ Hz and $S_1(2)=0.5$ Hz equals $\frac{1}{2}(S_1(1)+S_1(2))=\frac{1}{2}(1\text{ Hz}+0.5\text{ Hz})=0.75$ Hz. Therefore, the value of $E_{min1}$ is equal to 0.75 Hz.

In the above-mentioned examples, the value of $E_{max1}$ is equal to 5.5 Hz. The value of $E_{min1}$ is equal to 0.75 Hz. A value of the width of the pitch variation $R_1$ of the first audio file can be calculated through adopting the formulas (3). The value of the width of the pitch variation $R_1$ is equal to 4.75 Hz. It should be noted that the value of $m_1$ can be setup according to need. For example, the value of $m_1$ may be equal to 20% of the number $n_1$ of the pitches of the pitch sequence (namely $S_1$ sequence) of the first audio file, or the value of $m_1$ may be equal to 10% of the number $n_1$ of the pitches of the pitch sequence (namely $S_1$ sequence) of the first audio file.

d) For the proportion of the pitch ascending, it represents a proportion of the number of rose pitches in the pitch sequence (namely $S_1$ sequence) of the first audio file. The proportion of the pitch ascending is expressed as $UP_1$. In the pitch sequence (namely $S_1$ sequence) of the first audio file, per detecting $S_1(i+1)-S_1(i)>0$, it denotes that the pitches ascend once. In the step 205, the proportion of the pitch ascending $UP_1$ of the first audio file can be calculated through adopting the following formulas (4):

$$UP_1=N_{up1}/(n_1 1) \tag{4}$$

Wherein, $N_{up1}$ denotes the number of the pitches ascending of the first audio file; $n_1$ is a positive integer, $n_1$ denotes the number of the pitches of the pitch sequence (namely $S_1$ sequence) of the first audio file.

e) For the proportion of the pitch descending, it represents a proportion of the number of ascending pitches in the pitch sequence (namely $S_1$ sequence) of the first audio file. The proportion of the pitch ascending is expressed as $DOWN_1$. In the pitch sequence (namely $S_1$ sequence) of the first audio file, per detecting $S_1(i+1)-S_1(i)<0$, it denotes that the pitches descend once. In the step 205, the proportion of the pitch descending $DOWN_1$ of the first audio file can be calculated through adopting the following formulas (5):

$$DOWN_1=N_{down1}/(n_1 1) \tag{5}$$

Wherein, $N_{down1}$ denotes the number of the pitches descending of the first audio file; $n_1$ is a positive integer, $n_1$ denotes the number of the pitches of the pitch sequence (namely $S_1$ sequence) of the first audio file.

f) For the proportion of zero pitch, it represents a proportion of the zero pitches in the pitch sequence (namely $S_1$ sequence) of the first audio file. The proportion of the zero pitches is expressed as $ZERO_1$. In the pitch sequence (namely $S_1$ sequence) of the first audio file, per detecting $S_1(i)<0$, it denotes that the zero pitch appears once. In the step 205, the proportion of the zero pitch $ZERO_1$ of the first audio file can be calculated through adopting the following formulas (6):

$$\text{Zero}_1=N_{zero1}/n_l \tag{6}$$

Wherein, $N_{zero1}$ denotes the number of the zero pitches appearing of the first audio file; $n_1$ is a positive integer, $n_1$ denotes the number of the pitches of the pitch sequence (namely $S_1$ sequence) of the first audio file.

g) For the average rate of the pitch ascending, it represents an average time of the pitch sequence (namely $S_1$ sequence) of the first audio file varying from low to high spending. The average rate of the pitch ascending is expressed as $Su_1$. In the step 205, a process of calculating the average rate of the pitch ascending $Su_1$ of the first audio file includes the following three steps:

g1.1): determining ascending paragraphs of the pitches of the pitch sequence (namely $S_1$ sequence) of the first audio file, and counting up the number of ascending paragraphs and the number of the pitches in each ascending paragraph. And the maximum value of the pitches and the minimum value of the pitches in each ascending paragraph are counted up. For example, suppose that the pitch sequence (namely $S_1$ sequence) of the first audio file includes the ten pitches, which are $S_1(1)=1$ Hz, $S_1(2)=0.5$ Hz, $S_1(3)=4$ Hz, $S_1(3)=4$ Hz, $S_1(4)=2$ Hz, $S_1(5)=5$ Hz, $S_1(6)=1.5$ Hz, $S_1(7)=3$ Hz, $S_1(8)=2.5$ Hz, $S_1(9)=3.5$ Hz, $S_1(10)=6$ Hz. The following four ascending paragraphs of the pitches of the $S_1$ sequence are determined: "$S_1(2)-S_1(3)$", "$S_1(4)-S_1(5)$", "$S_1(6)-S_1(7)$" and "$S_1(9)-S_1(10)$". Therefore, $p_{up}=4$, wherein the first ascending paragraph includes two pitches, which are $S_1(2)$ and $S_1(3)$. That is, $q_{up1-1}=2$; the maximum value of the pitches of the first ascending paragraph $\max_{up1-1}$ is equal to 4 Hz. The minimum value of the pitches of the first ascending paragraph $\text{mim}_{up1-1}$ is equal to 0.5 Hz. The second ascending paragraph includes two pitches, which are $S_1(4)$ and $S_1(5)$. That is, $q_{up1-2}=2$; the maximum value of the pitches of the second ascending paragraph $\max_{up1-2}$ is equal to 5 Hz. The minimum value of the pitches of the second ascending paragraph $\text{mim}_{up1-2}$ is equal to 2 Hz. The third ascending paragraph includes two pitches, which are $S_1(6)$ and $S_1(7)$. That is, $q_{up1-3}=2$; the maximum value of the pitches of the third ascending paragraph $\max_{up1-3}$ is equal to 3 Hz. The minimum value of the pitches of the third ascending paragraph $mim_{up1-3}$ is equal to 1.5 Hz. The fourth ascending paragraph includes three pitches, which are $S_1(8)$, $S_1(9)$ and $S_1(10)$. That is, $q_{up1-4}=3$; the maximum value of the pitches of the fourth ascending paragraph $max_{up1-4}$ is equal to 6 Hz. The minimum value of the pitches of the fourth ascending paragraph $mim_{up1-4}$ is equal to 2.5 Hz.

g1.2): calculating a slope of each ascending paragraph of the pitch sequence (namely $S_1$ sequence) of the first audio file. In the step 205, the slope of each ascending paragraph can be calculated through adopting the following formulas (7):

$$k_{up1-j}=(\max_{up1-j}-\min_{up1-j})/q_{up1-j} \tag{7}$$

Wherein, j is a integer, and $j \le p_{up1}$. The up1−j denotes a serial number of the ascending paragraphs of the Pitch sequence ((namely $S_1$ sequence) of the first audio file; $k_{up1-j}$ denotes the slope of any ascending paragraph of the pitch sequence ((namely $S_1$ sequence) of the first audio file.

It should be noted, according to the example of the above-mentioned step g1.1), the step 205 can obtain four slopes of the ascending paragraphs through the formulas (7), which are $k_{up1-1}$, $k_{up1-2}$, $k_{up1-3}$, $k_{up1-4}$. Process of calculating the four slopes of the ascending paragraphs are respectively as follows:

$$k_{up1-1}=(\max_{up1-1}-\min_{up1-1})/q_{up1-1}=(4-0.5)/2=1.75$$

$$k_{up1-2}=(\max_{up1-2}-\min_{up1-2})/q_{up1-2}=(5-2)/2=1.5$$

$$k_{up1-3}=(\max_{up1-3}-\min_{up1-3})/q_{up1-3}=(3-1.5)/2=0.75$$

$$k_{up1-4}=(\max_{up1-4}-\min_{up1-4})/q_{up1-4}=(6-2.5)/3\approx 1.17$$

g1.3): calculating the average rate of the ascending pitch of the first audio file. In the step 205, the average rate of the ascending pitches of the audio file can be calculated through adopting the following formulas (8):

$$Su_1 = \frac{1}{p_{up1}} \sum_{j=1}^{p_{up1}} k_{up1-j} \tag{8}$$

It should be noted, according to the examples of the above-mentioned steps g1.1) and g1.2), the step 205 can obtain the average rate of the ascending pitches of the first audio file through the formulas (7). The average rate is as follow:

$$Su_1 = \frac{1}{p_{up1}} \sum_{j=1}^{p_{up1}} k_{up1-j} = \frac{1}{4}(1.75 + 1.5 + 0.75 + 1.17) = 1.2925$$

h) For the average rate of the pitch descending, it represents an average time of the pitch sequence (namely $S_1$ sequence) of the first audio file varying from low to high spending. The average rate of the pitch descending is expressed as $Sd_1$. In the step 205, a process of calculating the average rate of the pitch descending $Sd_1$ of the first audio file includes the following three steps:

h1.1): determining descending paragraphs of the pitches of the pitch sequence (namely $S_1$ sequence) of the first audio file, and counting up the number of descending paragraphs and the number of the pitches in each descending paragraph. And the maximum value of the pitches and the minimum value of the pitches in each descending paragraph are counted up. For example, suppose that the pitch sequence (namely $S_1$ sequence) of the first audio file includes the ten pitches, which are $S_1(1)=1$ Hz, $S_1(2)=0.5$ Hz, $S_1(3)=4$ Hz, $S_1(3)=4$ Hz, $S_1(4)=2$ Hz, $S_1(5)=5$ Hz, $S_1(6)=1.5$ Hz, $S_1(7)=3$ Hz, $S_1(8)=2.5$ Hz, $S_1(9)=3.5$ Hz, $S_1(10)=6$ Hz. The following four descending paragraphs of the pitches of the $S_1$ sequence are determined: "$S_1(1)$-$S_1(2)$", "$S_1(3)$-$S_1(4)$", "$S_1(5)$-$S_1(6)$" and "$S_1(7)$-$S_1(8)$". Therefore, $p_{down}=4$, wherein the first descending paragraph includes two pitches, which are $S_1(1)$ and $S_1(2)$. That is, $q_{down1-1}=2$; the maximum value of the pitches of the first descending paragraph $max_{down1-1}$ is equal to 1 Hz. The minimum value of the pitches of the first descending paragraph $mim_{down1-1}$ is equal to 0.5 Hz. The second descending paragraph includes two pitches, which are $S_1(3)$ and $S_1(4)$. That is, $q_{down1-2}=2$; the maximum value of the pitches of the second descending paragraph $max_{down1-2}$ is equal to 5 Hz. The minimum value of the pitches of the second descending paragraph $mim_{down1-2}$ is equal to 2 Hz. The third descending paragraph includes two pitches, which are $S_1(5)$ and $S_1(6)$. That is, $q_{down1-3}=2$; the maximum value of the pitches of the third descending paragraph $max_{down1-3}$ is equal to 5 Hz. The minimum value of the pitches of the third descending paragraph $mim_{down1-3}$ is equal to 1.5 Hz. The fourth descending paragraph includes two pitches, which are $S_1(7)$ and $S_1(8)$. That is, $q_{down1-4}=2$; the maximum value of the pitches of the fourth descending paragraph $max_{down1-4}$ is equal to 3 Hz. The minimum value of the pitches of the fourth ascending paragraph $mim_{down1-4}$ is equal to 2.5 Hz.

h1.2): calculating a slope of each descending paragraph of the pitch sequence (namely $S_1$ sequence) of the first audio file. In the step 205, the slope of each descending paragraph can be calculated through adopting the following formulas (9):

$$k_{down1-j}=(\max_{down1-j}-\min_{down1-j})/q_{down1-j} \tag{9}$$

Wherein, j is a integer, and $j \le p_{down1}$. The down1-j denotes a serial number of the descending paragraphs of the Pitch sequence ((namely $S_1$ sequence) of the first audio file; $k_{down1-j}$ denotes the slope of any descending paragraph of the pitch sequence ((namely $S_1$ sequence) of the first audio file.

It should be noted, according to the example of the above-mentioned step h1.1), the step 205 can obtain four slopes of the descending paragraphs through the formulas (9), which are $k_{down1-1}$, $k_{down1-2}$, $k_{down1-3}$, $k_{down1-4}$. Process of calculating the four slopes of the descending paragraphs are respectively as follows:

$$k_{down1-1}=(\max_{down1-1}-\min_{down1-1})/q_{down1-1}=(1-0.5)/2=0.25$$

$$k_{down1-2}=(\max_{down1-2}-\min_{down1-2})/q_{down1-2}=(4-2)/=2=1$$

$$k_{down1-3}=(\max_{down1-3}-\min_{down1-3})/q_{down1-3}=(5-1.5)/2=1.75$$

$$k_{down1-4}=(\max_{down1-4}-\min_{down1-4})/q_{down1-4}=(3-2.5)/2=0.25$$

h1.3): calculating the average rate of the descending pitch of the first audio file. In the step 205, the average rate of the descending pitches of the audio file can be calculated through adopting the following formulas (10):

$$Sd_1 = \frac{1}{p_{down1}} \sum_{j=1}^{p_{down1}} k_{down1-j} \tag{10}$$

It should be noted, according to the examples of the above-mentioned steps h1.1) and h1.2), the step 205 can obtain the average rate of the descending pitches of the first audio file through the formulas (10). The average rate is as follow:

$$Sd_1 = \frac{1}{p_{down1}} \sum_{j=1}^{p_{down1}} k_{down1\text{-}j} = \frac{1}{4}(0.25 + 1 + 1.75 + 0.25) = 0.9375$$

It should be noted that the step 205 can obtain the following characteristic parameters through the above-mentioned a) to h). The characteristic parameters includes the pitch mean $E_1$, the pitch standard deviation $S_{td1}$ the width of the pitch variation $R_1$, the proportion of the pitch ascending $UP_1$, the proportion of the pitch descending $DOWN_1$, a proportion of zero pitch $Zero_1$, an average rate of the pitch ascending $Su_1$, and an average rate of the pitch descending $Sd_1$.

Step 206, storing the characteristic parameters of the first audio file in the form of an array, to generate the eigenvector of the first audio file.

In the step 206, the characteristic parameters of the first audio file are stored in the form of the array. Therefore, the characteristic parameters of the first audio file constitute the eigenvector of the first audio file. The eigenvector $M_1$ of the first audio file can be defined as $\{E_1, S_{td1}, R_1, UP_1, DOWN_1, Zero_1, Su_1, Sd_1\}$.

Step 207: calculating the characteristic parameters of the second audio file according to the pitch sequence of the second audio file.

The characteristic parameters may include, but are not limited to include only the following parameters: the pitch mean, the pitch standard deviation, the width of the pitch variation, the proportion of the pitch ascending, the proportion of the pitch descending, the proportion of zero pitch, the average rate of the pitch ascending, and the average rate of the pitch descending. In order to more accurately reflect audio contents of the second audio file, in the embodiment, preferably, the characteristic parameters of the second audio files includes the pitch mean, the pitch standard deviation, the width of the pitch variation, the proportion of the pitch ascending, the proportion of the pitch descending, the proportion of zero pitch, the average rate of the pitch ascending, and the average rate of the pitch descending. In the step 207, a process of calculating the characteristic parameters of the second audio file can be referred to the process of calculating the characteristic parameters of the first audio file. Therefore, the process of calculating the characteristic parameters of the second audio file will be not described. It should be noted the characteristic parameters calculated in the step 207 includes the pitch mean $E_2$, the pitch standard deviation $S_{td2}$, the width of the pitch variation $R_2$, the proportion of the pitch ascending $UP_2$, the proportion of the pitch descending $DOWN_2$, the proportion of zero pitch $Zero_2$, the average rate of the pitch ascending $Su_2$, and the average rate of the pitch descending $Sd_2$.

Step 208, storing the characteristic parameters of the second audio file in the form of an array, to generate the eigenvector of the second audio file.

In the step 208, the characteristic parameters of the second audio file are stored in the form of the array. Therefore, the characteristic parameters of the second audio file constitute the eigenvector of the second audio file. The eigenvector $M_2$ of the second audio file can be defined as $\{E_2, S_{td2}, R_2, UP_2, DOWN_2, Zero_2, Su_2, Sd_2\}$.

In the embodiment, the steps 205 and 207 are in no particular order on timing. The steps 205 and 207 can be simultaneously implemented. Or the steps 205 and 206 are implemented firstly, and then the steps 207 and 208 are implemented. Or the steps 207 and 208 are implemented firstly, and then the steps 205 and 206 are implemented. The steps 205-208 of the embodiment may be the detailed flow of the step 102 of the embodiment corresponding to the FIG. 1.

Step 209, calculating a Euclidean distance between the eigenvector of the first audio file and the eigenvector of the second audio file.

The Euclidean distance, also known as the Euclidean distance, which is generally used to define a distance, to reflect a real distance between two points in a multidimensional space. The step 209 can calculate the Euclidean distance between the eigenvector of the first audio file and the eigenvector of the second audio file through adopting the Euclidean distance calculation formulas.

Step 210: determining the calculated Euclidean distance to be as the similarity between the first audio file and the second audio file.

In the step 201, the Euclidean distance between the eigenvector of the first audio file and the eigenvector of the second file is determined to be as the similarity with the first and second audio files. Since the Euclidean distance reflects the real distance between two points in a multidimensional space, in the step 210, the Euclidean distance is determined to be as the similarity. That is, the Euclidean distance visually reflects the similarity between the two audio files. It should be noted that, if the Euclidean distance between the two audio files is smaller, it indicates that the similarity of the two audio files is higher. If the Euclidean distance between the two audio files is larger, it indicates that the similarity of the two audio files is lower.

The steps 209-210 of the embodiment may be the detailed flow of the step 103 of the embodiment corresponding to the FIG. 1.

In the embodiment, the method for constituting the pitch sequences of the first and second audio files, and calculating the eigenvectors of the first and second audio files based on the corresponding pitch sequences of the first and second audio files. Therefore, the audio contents of the audio files can be abstractly represented by the eigenvectors. Further, the similarity of the first and second audio files is calculated according to the eigenvectors of the first and second audio files. The similarity between the first and second audio files is calculated based on the audio contents of the first and second audio files. Therefore, that calculating the similarity between the first and second audio files is interfered by other factors excluding the audio contents of the first and second audio files, which improves the accuracy, efficiency, and intelligence of calculating the similarity of audio files.

Below combinative FIGS. 3-6, a device for calculating a similarity of audio files is described in detail. It should be noted that the device for calculating the similarity of the audio files showed in FIG. 3-6 is used to implement the above-mentioned method of the embodiments. For illustration purposes, FIGS. 3-6 only show a part related to the following embodiments. And some technical details are not shown in the FIGS. 3-6, see FIGS. 1 and 2 of the embodiment.

Figure 3:
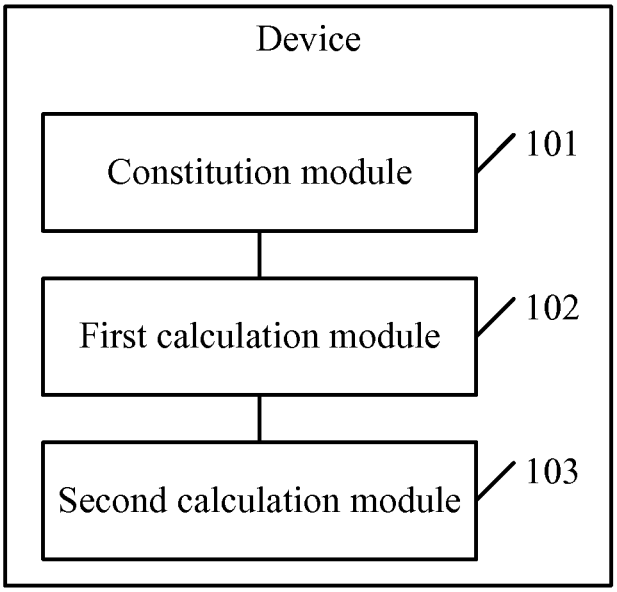
FIG. 3 is a block diagram of an example of a device for calculating a similarity of audio files according to various embodiments, the device including a constituting module, a vector calculation module, and a similarity calculation module.

Referring to FIG. 3, it is a block diagram of a device for calculating a similarity of audio files according to various embodiments. The device includes a constitution module 101, a first calculation module 102, and a second calculation module 103.

The constitution module 101 is used to constitute a pitch sequence of a first audio file and a pitch sequence of a second audio file.

An audio file can be represented as a sequence of frames which is composed of a plurality of audio frames. Frame length T and frame shift Ts are time. Values of the frame length T and the frame shift Ts can be determined according to need. For example, for a song, the value of the frame length T may be 20 ms, the value of the frame shift Ts may be 10 ms. Moreover, for a piece of music, the value of the frame length T may be 10 ms, the value of the frame shift Ts may be 5 ms. For different audio files, the value of the frame length T may be different, also may be the same. The value of the frame shift may be different, also may be the same. Each audio frame of the audio file carries the pitches. Melody information of the audio file is constituted by the pitches of each audio frame according to the time sequence of the audio frames. The constitution module 101 is used to constitute the pitch sequence of the first audio file according to the pitches of each audio frame of the first audio file. The constitution module 101 is also used to constitute the pitch sequence of the second audio file i according to the pitches of each audio frame of the second audio file. The pitch sequence of the first audio file includes the pitches of each audio frame of the first audio file. The melody of the first audio file is constituted by the pitches of the first audio file in sequence. The pitch sequence of the second audio file includes the pitches of each audio frame of the second audio file. The melody of the second audio file is constituted by the pitches of the second audio file in sequence.

The first calculation module 102 is used to calculate an eigenvector of the first audio file according to the pitch sequence of the first audio file, and calculate an eigenvector of the second audio file according to the pitch sequence of the second audio file.

Specifically, the eigenvector of the audio file can abstractly represent audio contents of the audio file. In detail, the eigenvector of the audio file can abstractly represent the audio contents of the audio file through characteristic parameters. The first eigenvector of the first audio file includes the characteristic parameters of the first audio file. The eigenvector of the second audio file includes the characteristic parameters of the second audio file. The characteristic parameters may include, but are not limited to include only the following parameters: a pitch mean, a pitch standard deviation, a width of the pitch variation, a proportion of the pitch ascending, a proportion of the pitch descending, a proportion of zero pitch, an average rate of the pitch ascending, and an average rate of the pitch descending.

The second calculation module 103 is used to calculate a similarity between the first audio file and the second audio file according to the eigenvector of the first audio file and the eigenvector of the second audio file.

Owing to the eigenvector of the audio file can abstractly represent the audio contents of the audio files, the second calculation module 103 can obtain the similarity between the first audio file and the second audio file through analyzing and calculating the eigenvectors of the first and second audio files. It should be noted that the second calculation module 103 calculates the similarity between the first and second audio files based on the audio contents of the first and second audio files. Therefore, that calculating the similarity between the first and second audio files is interfered by other factors excluding the audio contents of the first and second audio files, which improves an accuracy of calculating the similarity of audio files.

In the embodiment, the pitch sequences of the first and second audio files are constituted based on the corresponding eigenvectors of the first and second audio files. The above-mentioned method for calculating the similarity of the audio files adopts the eigenvectors to abstractly represent the audio contents of the audio files. Further, the similarity between the first and second audio files is calculated according to the eigenvectors of the first and second audio files. The similarity between the first and second audio files is calculated based on the audio contents of the first and second audio files. Therefore, that calculating the similarity between the first and second audio files is interfered by other factors excluding the audio contents of the first and second audio files, which improves the accuracy, efficiency, and intelligence of calculating the similarity of audio files.

Below combinative FIGS. 4-6, the constitution module 101, the first calculation module 102, and the second calculation module 103 shown in FIG. 3 are described in detail.

Figure 4:
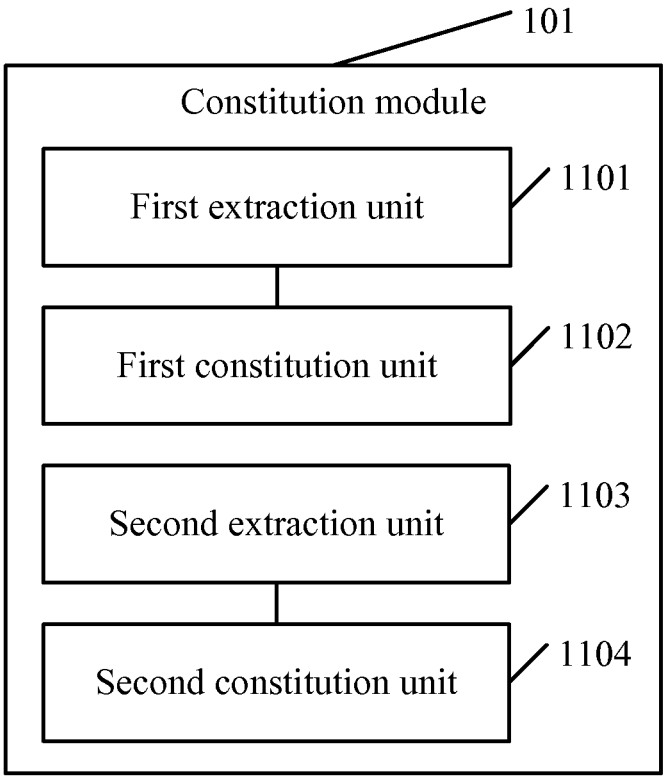
FIG. 4 is a block diagram of the constituting module of FIG. 3.

Referring to FIG. 4, the constitution module 101 may include a first extraction unit 1101, a first constitution unit 1102, a second extraction unit 1103, and a second constitution unit 1104.

The first extraction unit 1101 is used to extract the pitches of each audio frame of the first audio file.

An audio file can be represented as a sequence of frames which is composed of a plurality of audio frames. Frame length T and frame shift are time. Values of the frame length T and the frame shift Ts can be determined according to need. For example, for a song, the value of the frame length T may be 20 ms, the value of the frame shift Ts may be 10 ms. Moreover, for a piece of music, the value of the frame length T may be 10 ms, the value of the frame shift Ts may be 5 ms. For different audio files, the value of the frame length T may be different, also may be the same. The value of the frame shift Ts may be different, also may be the same. Each audio frame of the audio file carries the pitches. Melody information of the audio file is constituted by the pitches of each audio frame according to the time sequence of the audio frames. If the first audio file includes $n_1$ ($n_1$ is a positive integer) audio frames. The pitches of a first audio frame are defined as $S_1(1)$. The pitches of a second audio frame are defined as $S_1(2)$. By that analogy, the pitches of the $(n_1-1)$th audio frame are defined as $S_1(n_1-1)$. The pitches of the $n_1$th audio frame are defined as $S_1(n_1)$. The first extraction unit 1101 extracts the pitches $S_1(1)-S_1(n_1)$ from the first audio file.

The first constitution unit 1102 is used to constitute the pitch sequence of the first audio file according to the pitches of each audio frame of the first audio file.

The pitch sequence of the first audio file includes the pitches of each audio frame of the first audio file. The pitches of the Pitch sequence of the first audio file constitute the melody information of the first audio file in sequence. The pitch sequence of the first audio file is expressed as a $S_1$ sequence. The $S_1$ sequence includes $n_1$ pitches, which are $S_1(1)$, $S_1(2)$ . . . $S_1(n_1-1)$, $S_1(n_1)$. The $n_1$ pitches constitute the melody of the first audio file. Specifically, a process of the first constitution unit 1102 constituting the pitch sequence of the first audio file has the following two embodiments. In one of the two embodiments, the first constitution unit 1102 constitutes the pitch sequence of the first audio file through adopting a pitch extraction algorithm. The pitch extraction algorithm includes, but is not limited to include: an autocorrelation function method, a peak extraction algorithm, an average magnitude difference function method, a cepstrum method, and a spectrum method. In the other of the two embodiments, the first constitution unit 1102 constitutes the pitch sequence of the first audio file is constituted through adopting a pitch extraction tool. The pitch extraction tool includes, but is not limited to include: a fxpefac tool or a fxrapt tool of the voice box (a matlab voice processing tool box).

The second extraction unit 1103 is used to extract the pitches of each audio frame of the second audio file.

An extraction process of the second extraction unit 1103 extracting the pitches of each audio frame of the second audio file is the same as an extraction process of the first extraction unit 1101 extracting the pitches of each audio frame of the first audio file. Therefore, the extraction process of the second extraction unit 1103 extracting the pitches of each audio frame of the second audio file will not be described. If the second audio file includes $n_2$ ($n_2$ is a positive integer) audio frames. The pitches of a first audio frame is defined as $S_2(1)$. The pitches of a second audio frame is defined as $S_2(2)$. By that analogy, the pitches of the $(n_2-1)$th audio frame is defined as $S_2(n_2-1)$ The pitches of the $n_2$th audio frame is defined as $S_2(n_2)$. The second extraction unit 1103 extracts the pitches $S_2(1)-S_2(n_2)$ from the second audio file. It should be noted that $n_1$ and $n_2$ may be the same, also may be different.

The second constitution unit 1104 is used to constitute the pitch sequence of the second audio file according to the pitches of each audio frame of the second audio file.

The pitch sequence of the second audio file includes the pitches of each audio frame of the second audio file. The pitches of the pitch sequence of the second audio file constitute the melody information of the second audio file in sequence. The pitch sequence of the second audio file is expressed as a $S_2$ sequence. The $S_2$ sequence includes $n_2$ pitches, which are $S_2(1), S_2(2) \ldots S_2(n_2-1), S_2(n_2)$. The $n_2$ pitches constitute the melody of the second audio file. A constitution process of the second constitution unit 1104 constituting the melody information of the second audio file is the same as a constitution process of the first constitution unit 1102 constituting the melody information of the first audio file. Therefore, the constitution process of the second constitution unit 1104 constituting the melody information of the second audio file will not be described.

Figure 5:
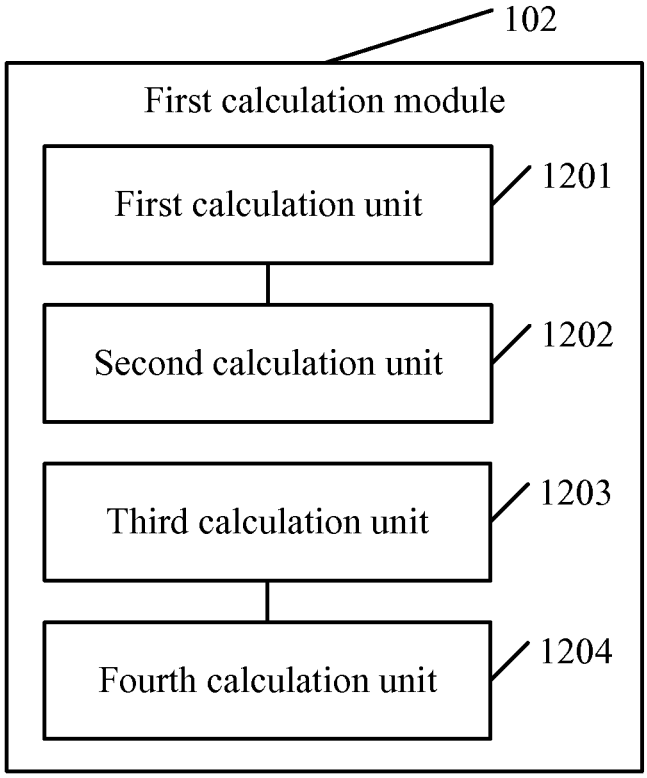
FIG. 5 is a block diagram of the vector calculation module of FIG. 3.

Referring to FIG. 5, it is a block diagram of the first calculation module 102 according to various embodiments. The first calculation module 102 may includes a first calculation unit 1201, a second calculation unit 1202, a third calculation unit 1203, and a fourth calculation unit 1204.

The first calculation unit 1201 is used to characteristic parameters of the first audio file according to the pitch sequence of the first audio file.

The characteristic parameters may include, but are not limited to include only the following parameters: a pitch mean, a pitch standard deviation, a width of the pitch variation, a proportion of the pitch ascending, a proportion of the pitch descending, a proportion of zero pitch, an average rate of the pitch ascending, and an average rate of the pitch descending. In order to more accurately reflect the audio content of the first audio file, in the embodiment, preferably, the characteristic parameters of the audio files includes the pitch mean, the pitch standard deviation, the width of the pitch variation, the proportion of the pitch ascending, the proportion of the pitch descending, the proportion of zero pitch, the average rate of the pitch ascending, and the average rate of the pitch descending. The definitions and calculations for each characteristic parameter of the first audio file are as follows:

a') For the pitch mean, it represents a mean pitch of the pitch sequence of the first audio file (namely the $S_1$ sequence). The pitch mean is expressed as $E_1$. The first calculation unit 1201 calculates the pitch mean $E_1$ of the first audio file through adopting the following formulas (1) of the embodiment corresponding to the FIG. 2. The detailed calculation process can be referred to the embodiment corresponding to the FIG. 2. Therefore, the detailed calculation process is not described here.

b') For the pitch standard deviation, it represents pitch variations of the pitch sequence (namely $S_1$ sequence) of the first audio file. The pitch standard deviation is expressed as $S_{td1}$. The first calculation unit 1201 calculates the pitch standard deviation $S_{td1}$ of the first audio file through adopting the following formulas (2) of the embodiment corresponding to the FIG. 2. The detailed calculation process can be referred to the embodiment corresponding to the FIG. 2. Therefore, the detailed calculation process is not described here.

c') For the width of the pitch variation, it represents a range of the pitch variation of the pitch sequence (namely $S_1$ sequence) of the first audio file. The width of the pitch variation is expressed as $R_1$. The first calculation unit 1201 calculates the width of the pitch variation $R_1$ of the first audio file through adopting the following formulas (3) of the embodiment corresponding to the FIG. 2. The detailed calculation process can be referred to the embodiment corresponding to the FIG. 2. Therefore, the detailed calculation process is not described here.

d') For the proportion of the pitch ascending, it represents a proportion of the number of rose pitches in the Pitch sequence (namely $S_1$ sequence) of the first audio file. The proportion of the pitch ascending is expressed as $UP_1$. In the pitch sequence (namely $S_1$ sequence) of the first audio file, per detecting $S_1(i+1)-S_1(i)>0$, it denotes that the pitches ascend once. The first calculation unit 1201 calculates the proportion of the pitch ascending $UP_1$ of the first audio file through adopting the following formulas (4) of the embodiment corresponding to the FIG. 2. The detailed calculation process can be referred to the embodiment corresponding to the FIG. 2. Therefore, the detailed calculation process is not described here.

e') For the proportion of the pitch descending, it represents a proportion of the number of ascending pitches in the pitch sequence (namely $S_1$ sequence) of the first audio file. The proportion of the pitch ascending is expressed as $DOWN_1$. In the pitch sequence (namely $S_1$ sequence) of the first audio file, per detecting $S_1(i+1)-S_1(i)<0$, it denotes that the pitches descend once. The first calculation unit 1201 calculates the proportion of the pitch descending $DOWN_1$ of the first audio file through adopting the following formulas (5) of the embodiment corresponding to the FIG. 2. The detailed calculation process can be referred to the embodiment corresponding to the FIG. 2. Therefore, the detailed calculation process is not described here.

f) For the proportion of zero pitch, it represents a proportion of the zero pitches in the pitch sequence (namely $S_1$ sequence) of the first audio file. The proportion of the zero pitches is expressed as $ZERO_1$. In the Pitch sequence (namely $S_1$ sequence) of the first audio file, per detecting $S_1(i)<0$, it denotes that the zero pitch appears once. The first calculation unit 1201 calculates the proportion of the zero pitch $ZERO_1$ of the first audio file through adopting the following formulas (6) of the embodiment corresponding to the FIG. 2. The detailed calculation process can be referred to the embodiment corresponding to the FIG. 2. Therefore, the detailed calculation process is not described here.

g') For the average rate of the pitch ascending, it represents an average time of the Pitch sequence (namely $S_1$ sequence) of the first audio file varying from low to high spending. The average rate of the pitch ascending is expressed as $Su_1$. A process of the first calculation unit 1201 calculating the average rate of the pitch ascending $Su_1$ of the first audio file can be referred to the embodiment corresponding to the FIG. 2. The process of the first calculation unit 1201 calculating the average rate of the pitch ascending $Su_1$ of the first audio file is not described here.

h) For the average rate of the pitch descending, it represents an average time of the Pitch sequence (namely $S_1$ sequence) of the first audio file varying from low to high spending. The average rate of the pitch descending is expressed as $Sd_1$. A process of the first calculation unit 1201 calculating the average rate of the pitch descending $Sd_1$ of the first audio file can be referred to the embodiment corresponding to the FIG. 2. The process of the first calculation unit 1201 calculating the average rate of the pitch descending $Sd_1$ of the first audio file is not described here.

It should be noted that the first calculation unit 1201 can obtain the following characteristic parameters through the above-mentioned a') to h'). The characteristic parameters includes the pitch mean $E_1$, the pitch standard deviation $S_{td1}$, the width of the pitch variation $R_1$, the proportion of the pitch ascending $UP_1$, the proportion of the pitch descending $DOWN_1$, a proportion of zero pitch $Zero_1$, an average rate of the pitch ascending $Su_1$, and an average rate of the pitch descending $Sd_1$.

The second calculation unit 1202 is used to store the characteristic parameters of the first audio file in the form of an array, to generate the eigenvector of the first audio file.

The second calculation unit 1202 stores the characteristic parameters of the first audio file in the form of the array. Therefore, the characteristic parameters of the first audio file constitute the eigenvector of the first audio file. The eigenvector $M_1$ of the first audio file can be defined as $\{E_1,S_{td1},R_1,UP_1,DOWN_1,Zero_1,Su_1,Sd_1\}$.

The third calculation unit 1203 is use to calculate the characteristic parameters of the second audio file according to the pitch sequence of the second audio file.

The characteristic parameters may include, but are not limited to include only the following parameters: the pitch mean, the pitch standard deviation, the width of the pitch variation, the proportion of the pitch ascending, the proportion of the pitch descending, the proportion of zero pitch, the average rate of the pitch ascending, and the average rate of the pitch descending. In order to more accurately reflect audio contents of the second audio file, in the embodiment, preferably, the characteristic parameters of the second audio files includes the pitch mean, the pitch standard deviation, the width of the pitch variation, the proportion of the pitch ascending, the proportion of the pitch descending, the proportion of zero pitch, the average rate of the pitch ascending, and the average rate of the pitch descending. A process of the third calculation unit 1203 calculating the characteristic parameters of the second audio file can be referred to the process of the first calculation unit 1201 calculating the characteristic parameters of the first audio file. Therefore, the process of the third calculation unit 1203 calculating the characteristic parameters of the second audio file will be not described. It should be noted the characteristic parameters calculated by the third calculation unit 1203 includes the pitch mean $E_2$, the pitch standard deviation $S_{td2}$, the width of the pitch variation $R_2$, the proportion of the pitch ascending $UP_2$, the proportion of the pitch descending $DOWN_2$, a proportion of zero pitch $Zero_2$, an average rate of the pitch ascending $Su_2$, and an average rate of the pitch descending $Sd_2$.

The fourth calculation unit 1204 is used to store the characteristic parameters of the second audio file in the form of an array, to generate the eigenvector of the second audio file.

The fourth calculation unit 1204 stores the characteristic parameters of the second audio file in the form of the array. Therefore, the characteristic parameters of the second audio file constitute the eigenvector of the second audio file. The eigenvector $M_2$ of the second audio file can be defined as $\{E_2,S_{td2},R_2,UP_2,DOWN_2,Zero_2,Su_2,Sd_2\}$.

Figure 6:
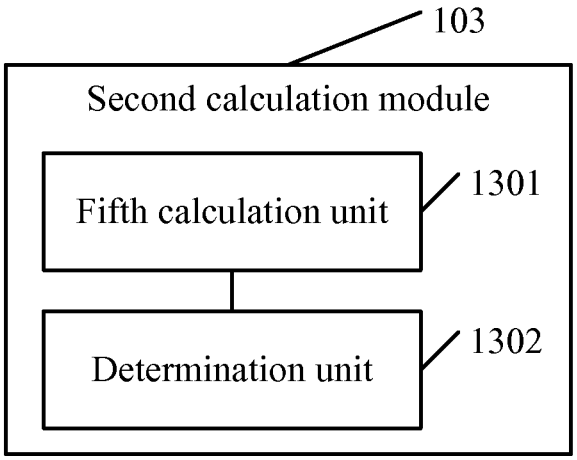
FIG. 6 is a block diagram of the similarity calculation module of FIG. 3.

Referring to FIG. 6, it is a block diagram of the second calculation module 103 according to various embodiments. The second calculation module 103 may include a fifth calculation unit 1301 and a determination unit 1302.

The fifth calculation unit 1301 is used to calculate a Euclidean distance between the eigenvector of the first audio file and the eigenvector of the second audio file.

The Euclidean distance, also known as the Euclidean distance, which is generally used to define a distance, to reflect a real distance between two points in a multidimensional space. The fifth calculation unit 1301 can calculate the Euclidean distance between the eigenvector of the first audio file and the eigenvector of the second audio file through adopting the Euclidean distance calculation formulas.

The determination unit 1302 is used to determine the calculated Euclidean distance to be as the similarity between the first audio file and the second audio file.

The determination unit 1302 determinates the Euclidean distance between the eigenvector of the first audio file and the eigenvector of the second file to be as the similarity with the first and second audio files. Since the Euclidean distance reflects the real distance between two points in a multidimensional space, the Euclidean distance is determined to be as the similarity. That is, the Euclidean distance visually reflects the similarity between the two audio files. It should be noted that, if the Euclidean distance between the two audio files is smaller, it indicates that the similarity of the two audio files is higher. If the Euclidean distance between the two audio files is larger, it indicates that the similarity of the two audio files is lower.

It should be noted that the structure and function of the device for calculating a similarity of audio files is described in detail can implement the method for calculating a similarity of audio files corresponding to the FIGS. 1 and 2. A detailed implementing process can be referred to the embodiment corresponding to the FIGS. 1 and 2. The detailed implementing process is not be described.

In the embodiment, the method for constituting the pitch sequences of the first and second audio files, and calculating the eigenvectors of the first and second audio files based on the corresponding pitch sequences of the first and second audio files. Therefore, the audio contents of the audio files can be abstractly represented by the eigenvectors. Further, the similarity of the first and second audio files is calculated according to the eigenvectors of the first and second audio files. The similarity between the first and second audio files is calculated based on the audio contents of the first and second audio files. Therefore, that calculating the similarity between the first and second audio files is interfered by other factors excluding the audio contents of the first and second audio files, which improves the accuracy, efficiency, and intelligence of calculating the similarity of audio files.

A person having ordinary skills in the art can realize that part or whole of the processes in the methods according to the above embodiments may be implemented by a computer program instructing relevant hardware. The program may be stored in a computer readable storage medium. When executed, the program may execute processes in the above-mentioned embodiments of methods. The storage medium may be a magnetic disk, an optical disk, a Read-Only Memory (ROM), a Random Access Memory (RAM), et al.

The above descriptions are some exemplary embodiments of the invention, and should not be regarded as limitation to the scope of related claims. A person having ordinary skills in a relevant technical field will be able to make improvements and modifications within the spirit of the principle of the invention. The improvements and modifications should also be incorporated in the scope of the claims attached below.

What is claimed is:

1. A method for calculating a similarity of audio files, comprising:

constituting a pitch sequence of a first audio file and a pitch sequence of a second audio file;

calculating an eigenvector of the first audio file according to the pitch sequence of the first audio file, which comprises: calculating characteristic parameters of the first audio file according to the pitch sequence of the first audio file; storing the characteristic parameters of the first audio file in the form of an array, to generate the eigenvector of the first audio file; and calculating an eigenvector of the second audio file according to the pitch sequence of the second audio file, which comprises: calculating characteristic parameters of the second audio file according to the pitch sequence of the second audio file; storing the characteristic parameters of the second audio file in the form of an array, to generate the eigenvector of the second audio file; wherein, the characteristic parameters comprise at least one of a proportion of the pitch ascending, a proportion of the pitch descending, an average rate of the pitch ascending, and an average rate of the pitch descending; and calculating a similarity between the first audio file and the second audio file according to the eigenvector of the first audio file and the eigenvector of the second audio file.

2. The method according to claim 1, wherein the constituting a pitch sequence of a first audio file comprises:

extracting pitches of each audio frame of the first audio file;

constituting the pitch sequence of the first audio file according to the pitches of each audio frame of the first audio file; the constituting a pitch sequence of a second audio file comprises:

extracting pitches of each audio frame of the second audio file;

constituting the pitch sequence of the second audio file according to the pitches of each audio frame of the second audio file.

3. The method according to claim 2, wherein the calculating a similarity between the first audio file and the second audio file according to the eigenvector of the first audio file and the eigenvector of the second audio file comprises:

calculating a Euclidean distance between the eigenvector of the first audio file and the eigenvector of the second audio file;

determining a calculated Euclidean distance to be as the similarity between the first audio file and the second audio file.

4. The method according to claim 1, wherein the calculating a similarity between the first audio file and the second audio file according to the eigenvector of the first audio file and the eigenvector of the second audio file comprises:

calculating a Euclidean distance between the eigenvector of the first audio file and the eigenvector of the second audio file;

determining a calculated Euclidean distance to be as the similarity between the first audio file and the second audio file.

5. A device for calculating a similarity of audio files, comprising:

a constitution module configured to constitute a pitch sequence of a first audio file and a pitch sequence of a second audio file;

a first calculation module configured to calculate an eigenvector of the first audio file according to the pitch sequence of the first audio file, and calculate an eigenvector of the second audio file according to the pitch sequence of the second audio file; wherein the first calculation module comprises:

a first calculation unit configured to calculate characteristic parameters of the first audio file according to the pitch sequence of the first audio file;

a second calculation unit configured to store the characteristic parameters of the first audio file in the form of an array, to generate the eigenvector of the first audio file;

a second calculation module configured to calculate a similarity between the first audio file and the second audio file according to the eigenvector of the first audio file and the eigenvector of the second audio file; wherein the second calculation module comprises:

a third calculation unit configured to calculate characteristic parameters of the second audio file according to the pitch sequence of the second audio file; and a fourth calculation unit configured to store the characteristic parameters of the second audio file in the form of an array, to generate the eigenvector of the second audio file;

wherein, the characteristic parameters comprise at least one of a proportion of the pitch ascending, a proportion of the pitch descending, an average rate of the pitch ascending, and an average rate of the pitch descending.

6. The device according to claim 5, wherein the constitution module comprises:

a first extraction unit configured to extract pitches of each audio frame of the first audio file;

a first constitution unit configured to constitute the pitch sequence of the first audio file according to the pitches of each audio frame of the first audio file;

a second extraction unit configured to extract pitches of each audio frame of the second audio file;

a second constitution unit configured to constitute the pitch sequence of the second audio file according to the pitches of each audio frame of the second audio file.

7. The device according to claim 6, wherein the second calculation module comprises:

a fifth calculation unit configured to calculate a Euclidean distance between the eigenvector of the first audio file and the eigenvector of the second audio file;

a determination unit configured to determine a calculated Euclidean distance to be as the similarity between the first audio file and the second audio file.

8. The device according to claim 5, wherein the second calculation module comprises:

a fifth calculation unit configured to calculate a Euclidean distance between the eigenvector of the first audio file and the eigenvector of the second audio file;

a determination unit configured to determine a calculated Euclidean distance to be as the similarity between the first audio file and the second audio file.

9. A non-transitory computer readable storage medium, storing one or more programs for execution by one or more processors of a computer having a display, the one or more programs comprising instructions for:

constituting a pitch sequence of a first audio file and a pitch sequence of a second audio file;

calculating an eigenvector of the first audio file according to the pitch sequence of the first audio file, which comprises: calculating characteristic parameters of the first audio file according to the pitch sequence of the first audio file; storing the characteristic parameters of the first audio file in the form of an array, to generate the eigenvector of the first audio file; and calculating an eigenvector of the second audio file according to the pitch sequence of the second audio file, which comprises: calculating characteristic parameters of the second audio file according to the pitch sequence of the second audio file; storing the characteristic parameters of the second audio file in the form of an array, to generate the eigenvector of the second audio file; wherein, the characteristic parameters comprise at least one of a proportion of the pitch ascending, a proportion of the pitch descending, an average rate of the pitch ascending, and an average rate of the pitch descending; and calculating a similarity between the first audio file and the second audio file according to the eigenvector of the first audio file and the eigenvector of the second audio file.

* * * * *